US007108583B1

(12) United States Patent
Heilmaier et al.

(10) Patent No.: US 7,108,583 B1
(45) Date of Patent: Sep. 19, 2006

(54) METHOD FOR REMOVING MATERIAL FROM A SEMICONDUCTOR WAFER

(75) Inventors: Alexander Heilmaier, Haiming (DE); Robert Drexler, Kirchdorf (DE); Anton Huber, Burghausen (DE); Robert Weiss, Winhöring (DE)

(73) Assignee: Siltronic AG, Munich (DE)

( * ) Notice: Subject to any disclaimer, the term of this patent is extended or adjusted under 35 U.S.C. 154(b) by 0 days.

(21) Appl. No.: 11/377,946

(22) Filed: Mar. 16, 2006

(30) Foreign Application Priority Data

Mar. 17, 2005 (DE) ..... 10 2005 012 446

(51) Int. Cl.
*B24B 13/00* (2006.01)

(52) U.S. Cl. ..... 451/11; 451/41; 451/287

(58) Field of Classification Search ..... 451/5, 451/11, 41, 287, 288, 260, 290, 292; 51/5; 29/558

See application file for complete search history.

(56) References Cited

U.S. PATENT DOCUMENTS

| | | | | |
|---|---|---|---|---|
| 3,905,162 | A | 9/1975 | Lawrence et al. | |
| 4,663,890 | A * | 5/1987 | Brandt | 451/41 |
| 5,400,548 | A | 3/1995 | Huber et al. | |
| 5,679,212 | A * | 10/1997 | Kato et al. | 438/692 |
| 6,406,357 | B1 | 6/2002 | Kazui et al. | |
| 6,419,564 | B1 * | 7/2002 | Herrman et al. | 451/58 |
| 6,752,694 | B1 * | 6/2004 | Schneegans et al. | 451/8 |
| 2002/0160691 | A1 * | 10/2002 | Ishikawa et al. | 451/8 |

FOREIGN PATENT DOCUMENTS

| | | |
|---|---|---|
| EP | 1004399 | 5/2000 |
| EP | 0955126 | 10/2002 |

* cited by examiner

*Primary Examiner*—Lee D. Wilson
*Assistant Examiner*—Anthony Ojini
(74) *Attorney, Agent, or Firm*—Kolisch Hartwell, P.C.

(57) ABSTRACT

The invention relates to a method for removing material from a semiconductor wafer by machining, in which a semiconductor wafer held on a wafer holder and a grinding wheel lying opposite it are rotated independently of one another, the grinding wheel being arranged laterally offset with respect to the semiconductor wafer and being positioned in such a way that an axial center of the semiconductor wafer passes into a working range of the grinding wheel, the grinding wheel being moved in the direction of the semiconductor wafer at an infeed rate, with the result that grinding wheel and semiconductor wafer are advanced toward one another while the semiconductor wafer and grinding wheel are rotating about parallel axes, so that a surface of the semiconductor wafer is ground, with the grinding wheel being moved back at a return rate after a defined amount of material has been removed, wherein the grinding wheel and semiconductor wafer are advanced toward one another by a distance of 0.03–0.5 μm during one revolution of the semiconductor wafer.

20 Claims, 5 Drawing Sheets

METHOD FOR REMOVING MATERIAL FROM A SEMICONDUCTOR WAFER

The invention relates to a method for removing material from a semiconductor wafer by machining, in which a semiconductor wafer held on a wafer holder and a grinding wheel lying opposite it are rotated independently of one another, the grinding wheel being arranged laterally offset with respect to the semiconductor wafer and being positioned in such a way that an axial center of the semiconductor wafer passes into a working range of the grinding wheel, the grinding wheel being moved in the direction of the semiconductor wafer at an infeed rate, with the result that grinding wheel and semiconductor wafer are advanced toward one another while the semiconductor wafer and grinding wheel are rotating about parallel axes, so that a surface of the semiconductor wafer is ground, with the grinding wheel being moved back at a return rate after a defined amount of material has been removed.

The production of a semiconductor wafer comprises cutting the semiconductor wafer off a crystal followed by a plurality of successive material-removing machining steps. These machining steps are required in order to obtain surfaces that are as smooth as possible and make the sides of the semiconductor wafer parallel and to provide the semiconductor wafer with a rounded edge. Material-removing machining steps which are usually considered include edge-rounding, lapping or double-side grinding, etching and polishing of the semiconductor wafer. Machining steps such as double-side grinding and in particular lapping add damage to the wafer surface, requiring large amounts of material to be removed in the subsequent steps (etching, polishing).

This can be prevented by precision grinding of the semiconductor wafer, i.e. by surface grinding using a grinding wheel with a fine grain size. This step minimizes the damage to the semiconductor wafer caused by previous machining steps and means that only a small amount of material needs to be removed during the subsequent etching, or else the etching step can be dispensed with altogether. This in turn means that the deterioration in flatness which is usually associated with the etching is minimized and less material needs to be removed in the subsequent polishing step.

Methods and devices for the surface grinding of a semiconductor wafer are known, for example, as shown in U.S. Pat. No. 3,905,162, U.S. Pat. No. 5,400,548 or EP 0 955 126. There, one surface of a semiconductor wafer is held fixed on a wafer holder, while the opposite surface is machined using a grinding wheel as a result of wafer holder and grinding wheel rotating and being pressed against one another. The semiconductor wafer is secured to the wafer holder in such a way that its center substantially coincides with the center of rotation of the wafer holder. Moreover, the grinding wheel is positioned in such a way that the rotation center of the semiconductor wafer passes into a working region or the edge region, formed by teeth, of the grinding wheel. As a result, the entire surface of the semiconductor wafer can be ground without any movement in the grinding plane.

EP 1 004 399 discloses the fact that grinding striations at a constant distance from one another are observed when a method of this type is carried out on a ground surface. The distance between the grinding striations produced depends on the grinding parameters, in particular the rotational speeds of the wafer holder and the grinding wheel. There is a relationship between the distance between the grinding striations and the amount of material which needs to be removed in the subsequent polishing step in order to completely eliminate the grinding striations. To minimize the amount of material which needs to be removed by polishing, it is necessary to use low rotational speeds of the wafer holder on which the semiconductor wafer is located and for the distance between the grinding striations to be 1.6 mm or less.

However, when the global flatness of a semiconductor wafer which has been ground using a low rotational speed of the wafer holder is measured, a defect is found in the center of the semiconductor wafer. The global flatness relates to the entire surface of a semiconductor wafer minus an edge exclusion which is to be defined. It is described by the GBIR ("global backsurface-referenced ideal plane/range"=range of the positive and negative deviation from a backsurface referenced ideal plane for the entire front surface of the semiconductor wafer), which corresponds to the term TTV ("total thickness variation") which was previously customary.

The methods which are known from the prior art therefore have drawbacks in terms of geometry and nanotopography (unevenness on the surface of the semiconductor wafer in the nanometer range). The method described in EP 1 004 399 leads to a deterioration in the local geometry in the center of the semiconductor wafer, which is undesirable in particular because this defect in the center of the semiconductor wafer cannot be eliminated by removing small amounts of material by polishing. This negates a major benefit of surface grinding, namely that only small amounts of material need to be removed during the subsequent polishing operation.

Therefore, the method for the material removing machining of a semiconductor wafer described in the introduction is based on the object of improving the geometry of the machined semiconductor wafers.

In an embodiment of the invention, this object is achieved by virtue of the fact that the grinding wheel and semiconductor wafer are advanced toward one another by a distance of 0.03–0.5 μm during one revolution of the semiconductor wafer.

Semiconductor wafer and grinding wheel lie opposite one another and rotate about parallel axes while the grinding wheel and semiconductor wafer are being advanced toward one another and a surface of the semiconductor wafer is being ground.

The grinding wheel and semiconductor wafer are advanced toward one another at an infeed rate R. An advance x of grinding wheel and semiconductor wafer toward one another is given by the following relationship with the infeed rate R and the rotational speed n of the semiconductor wafer:

$$X = \frac{R}{n}$$

The grinding wheel and semiconductor wafer are advanced a distance x toward one another during one revolution of the semiconductor wafer.

The advance x of grinding wheel and semiconductor wafer toward one another is also to be understood as meaning the height of a grinding step which is formed on the semiconductor wafer during grinding after one revolution of the semiconductor wafer.

If the advance is too great, the grinding wheel or an action area of the grinding wheel, i.e. an area of the grinding wheel which is in contact with the semiconductor wafer and leads to the removal of material, impresses a grinding step in front of it on the semiconductor wafer during the grinding operation. In this case, the grinding wheel is grinding primarily by means of one of its side faces, and thus becomes worn at this side face. In this case, therefore, a side face of the grinding wheel is a main action area of the grinding wheel; the term main action area is to be understood as meaning that part of the action area or working area of the grinding wheel which is responsible for removing a majority of the material.

This can be avoided if the advance x is selected to be small enough, since this also causes the grinding step that forms to decrease in size. In this case, the main action area of the grinding wheel is no longer a side face of the grinding wheel, but rather fundamentally the entire surface of the grinding wheel or its working area which comes into contact with the semiconductor wafer. Since the advance is low but not zero, there is nevertheless a certain one sided wear to the grinding wheel which forms after a run in phase. The result of this wear is a shift in the main action area of the grinding wheel.

The advance between grinding wheel and semiconductor wafer is selected in such a way that the main action area of the grinding wheel touches each point on the surface of the semiconductor wafer just once during one revolution of the semiconductor wafer, i.e. each point on the surface of the semiconductor wafer is ground just once during one revolution of the semiconductor wafer.

In the method according to the invention, this is achieved by virtue of the fact that grinding wheel and semiconductor wafer are advanced toward one another by a distance of 0.03–0.5 μm during one revolution of the semiconductor wafer.

In this way, the defect which occurs in the center of the semiconductor wafer with the known method can be considerably reduced. This is because when carrying out the methods known from the prior art, the center of the semiconductor wafer is always ground as well and is therefore permanently subject to removal of material, whereas in the method according to the invention the diameter of the main action area of the grinding wheel becomes smaller, each point of the semiconductor wafer comes into contact with the grinding wheel only once during one revolution of the semiconductor wafer, and therefore each point on the semiconductor wafer undergoes substantially the same removal of material.

The grinding is stopped after the grinding operation by a spark out, in which the advance of grinding wheel and semiconductor wafer toward one another is ended while the two tables are still rotating, and by a slow escape, i.e. by a slow return of the grinding wheel at a return rate.

The table below gives a summary of values for the advance x of the grinding wheel which result for various rotational speeds n and infeed rates R. The infeed rates are in the range from 10–20 μm/min, and the rotational speeds of the semiconductor wafer are from 5–300 $min^{-1}$.

| | x = R/n | | | | |
|---|---|---|---|---|---|
| | n[$min^{-1}$] | | | | |
| R[μm/min] | 5 | 50 | 100 | 200 | 300 |
| 10 | 2.00 | 0.20 | 0.1 | 0.05 | 0.03 |
| 15 | 3.00 | 0.30 | 0.15 | 0.08 | 0.05 |
| 20 | 4.00 | 0.40 | 0.20 | 0.10 | 0.07 |

The invention is to be explained in more detail below with reference to FIGS. 1 to 10.

BRIEF DESCRIPTION OF THE FIGURES

FIG. 1 illustrates a device which is suitable for carrying out the method described. A semiconductor wafer 1 is located on a wafer holder 3. Above it is a grinding wheel 2 which is held on a table 4. Furthermore, teeth 21 of the grinding wheel 2 are indicated in the drawing. The wafer holder 3 and the table 4 are rotated independently of one another. The semiconductor wafer 1 is secured to the wafer holder 3 in such a way that its center coincides with a rotational center of the wafer holder 3, i.e. an axial center of the semiconductor wafer and an axis of rotation 5 of the wafer holder coincide. The table 4 is arranged laterally offset and positioned in such a way that the axial center 5 of the semiconductor wafer 1 passes into a working area, formed by teeth 21, of the grinding wheel 2. Table 4 together with the grinding wheel 2 rotates about an axis of rotation 6, while wafer holder 3 together with the semiconductor wafer 1 rotates about the axis of rotation 5. As a result of movement in the vertical direction, table 4 with grinding wheel 2 is pressed onto the semiconductor wafer 1 located on the wafer holder 3, with the result that the grinding wheel and semiconductor wafer are advanced toward one another and the surface of the semiconductor wafer 1 is ground.

FIG. 2 illustrates a semiconductor wafer 1 with a ground surface and a grinding step after one revolution of the semiconductor wafer 1. The grinding wheel and semiconductor wafer were advanced a distance x toward one another during this one revolution of the semiconductor wafer 1.

FIG. 3 illustrates an excerpt from a semiconductor wafer 1 and a tooth 21 of a grinding wheel 2. The grinding wheel pushes a grinding step in front of it. This is the case if the advance rate of grinding wheel and semiconductor wafer toward one another is high, i.e. for example 2 μm. The main action area of the tooth of the grinding wheel 2 is illustrated in hatched form.

FIG. 4 shows how the tooth 21 of the grinding wheel 2 becomes worn if a high advance rate is selected after a run in phase. The figure also illustrates how this leads to a shift in the main action area of the tooth 21 of the grinding wheel or in a grinding point 7. The grinding point 7 is the point on the tooth 21 of the grinding wheel 2 which first comes into contact with the semiconductor wafer 1.

FIG. 5 illustrates an excerpt from a semiconductor wafer 1 and a tooth 21 of a grinding wheel 2. The figure also shows the main action area of the tooth 21 of the grinding wheel 2 in hatched form if the advance rate of grinding wheel and semiconductor wafer toward one another is low, i.e. for example 0.1 μm. In principle, the entire surface of the tooth 21 of the grinding wheel 2 which is in contact with the semiconductor wafer 1 carries out grinding.

It can be seen from FIG. 6 that in the case of a low rate of advance of grinding wheel 2 and semiconductor wafer 1, the surface of the tooth 21 of the grinding wheel 2 becomes worn. This figure also illustrates the grinding point 7, which lies further to the right compared to FIG. 4. After a run in phase, the tooth 21 of the grinding wheel 2 becomes worn, resulting in a shift in the grinding point 7. A main action area which has been shifted slightly toward the center of the tooth 21 of the grinding wheel 2 is formed. Compared to FIG. 4, however, the main action area or grinding point 7 is shifted to the right. The result of this is that the diameter of the main action area of the grinding wheel 2 is smaller (cf. FIG. 7 and FIG. 8). It has been found that this is the case if the advance of grinding wheel and semiconductor wafer toward one another is 0.03–0.5 μm during one revolution of the semiconductor wafer.

FIG. 7 and FIG. 8 illustrate the influence of the method according to the invention on the center region. The figures illustrate two semiconductor wafers 1 and in each case the main action area 8 of the grinding wheel; in FIG. 7 each point of the semiconductor wafer 1, i.e. including the center region, comes into contact with the grinding wheel 2 only once during one revolution of the semiconductor wafer, which is the case with an advance of grinding wheel 2 and semiconductor wafer 1 toward one another of 0.03–0.5 μm, whereas in FIG. 8 the center region of the semiconductor wafer 1 is in constant contact with the main action area 8 of the grinding wheel, which occurs with a higher rate of advance of grinding wheel 2 and semiconductor wafer 1 toward one another.

It is in principle conceivable for a shift in the main action area of a grinding wheel as effected by the method according to the invention also to be achieved by a shift in the axis of rotation of the grinding wheel. However, since this is not possible for all the grinding machines which are customarily used and in any event entails a high expense, this is not the preferred option when carrying out the method described.

The semiconductor wafers which are machined using the method described are preferably wafers made from the semiconductor materials silicon, germanium, silicon-germanium or a compound semiconductor, such as GaAs, wafers made from single crystal semiconductor material, semiconductor wafers with an epitaxially deposited layer, semiconductor wafers with a strained layer, for example with a strained silicon layer or SOI (silicon-on-insulator) wafers.

In the method described, it is preferable to use grinding wheels with a fine grain size of #2000 or finer (grain sizes determined in accordance with Japanese Industrial Standard JIS R 6001:1998).

The infeed rate is preferably 10–20 μm/min.

The grinding wheel and semiconductor wafer are preferably advanced toward one another by a distance of 0.03–0.1 μm during one revolution of the semiconductor wafer.

The rotational speed of the grinding wheel is preferably 1000–5000 revolutions per minute (RPM).

The rotational speed of the semiconductor wafer during the grinding, during the spark out and during the return of the grinding wheel (escape), is preferably 50–00 RPM, particularly preferably 200–300 RPM.

Semiconductor wafers with a diameter of 300 mm were machined by means of grinding wheels with a fine grain size #2000 produced by Disco Corporation (grain size 5–6 μm). The infeed rate was in each case 10 μm/min.

EXAMPLE

A semiconductor wafer with a diameter of 300 mm was machined in accordance with the invention, namely with a low advance x=0.033 μm, and then tested for roughness and GBIR.

Semiconductor wafer 1, rotational speed of the semiconductor wafer n=300 RPM, advance x=0.033 μm.

The following values were found for the roughness:

Front surface: 89.9 Å±4.5 Å

Back surface: 86.7 Å±2.5 Å

Figure 1:
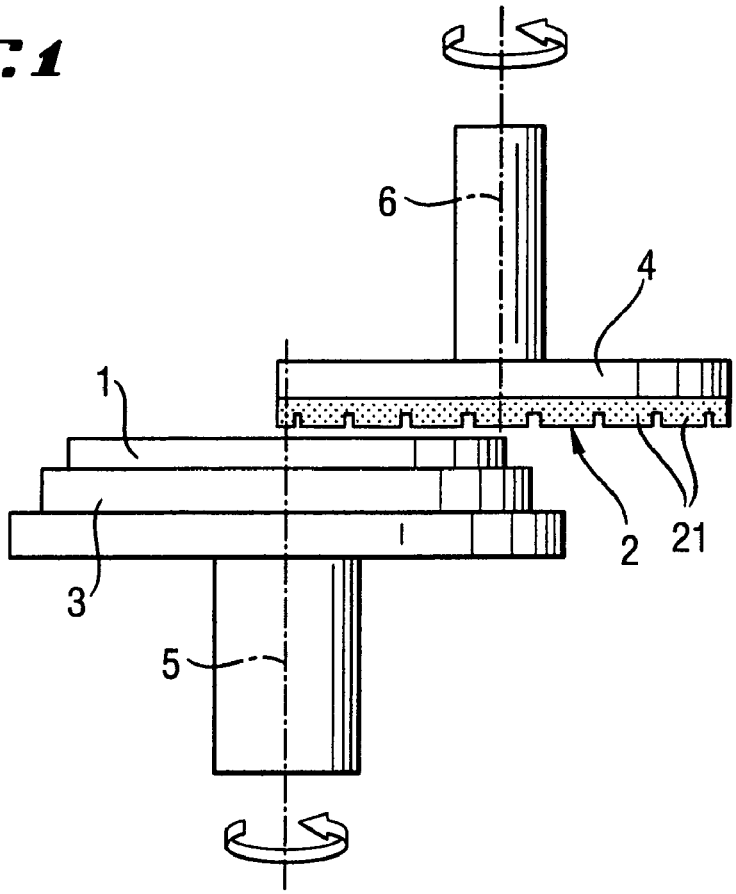
FIG. 1 shows a device which is suitable for carrying out the method described.
Figure 2:
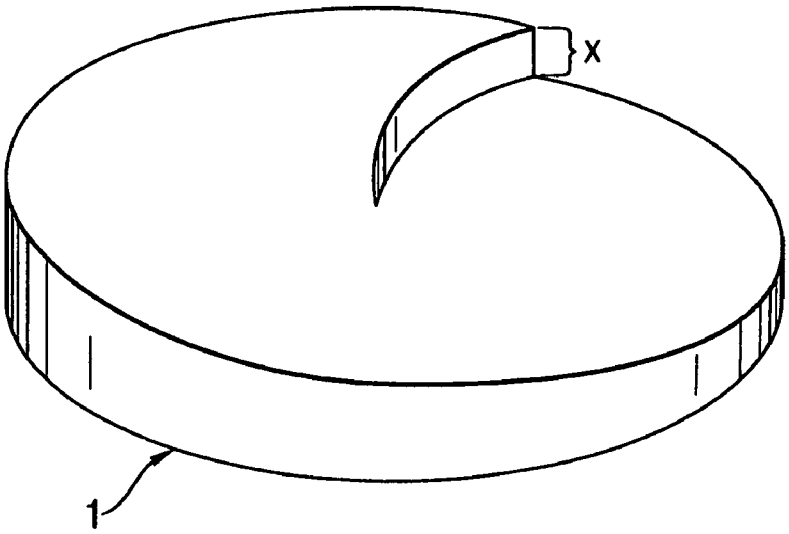
FIG. 2 shows a semiconductor wafer with a ground surface and a grinding step.
Figure 3:
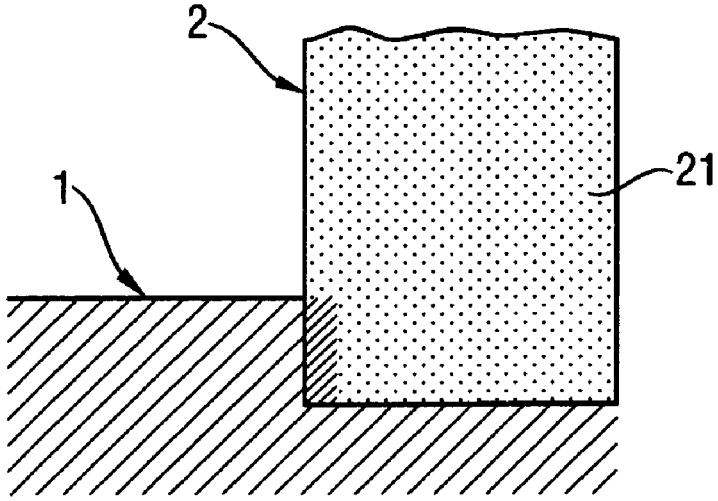
FIG. 3 shows a tooth of a grinding wheel and an excerpt from a semiconductor wafer as well as the main action area of the tooth of the grinding wheel in the case of a high rate of advance.
Figure 4:
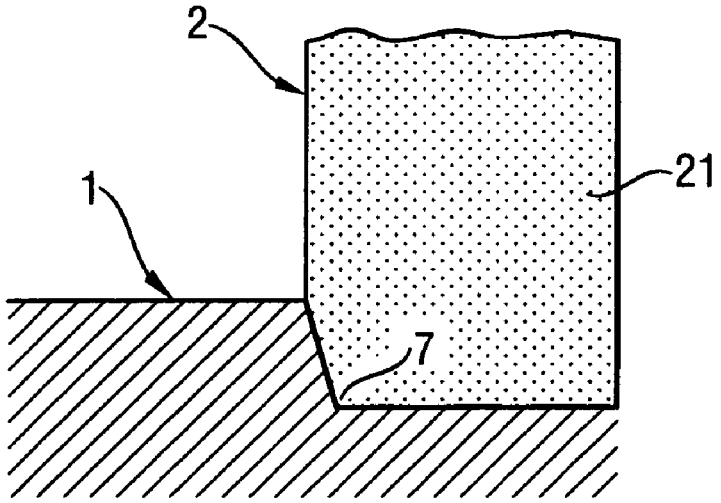
FIG. 4 shows a tooth of a grinding wheel and an excerpt from a semiconductor wafer as well as a grinding point after wear to the tooth of the grinding wheel in the case of a high rate of advance.
Figure 5:
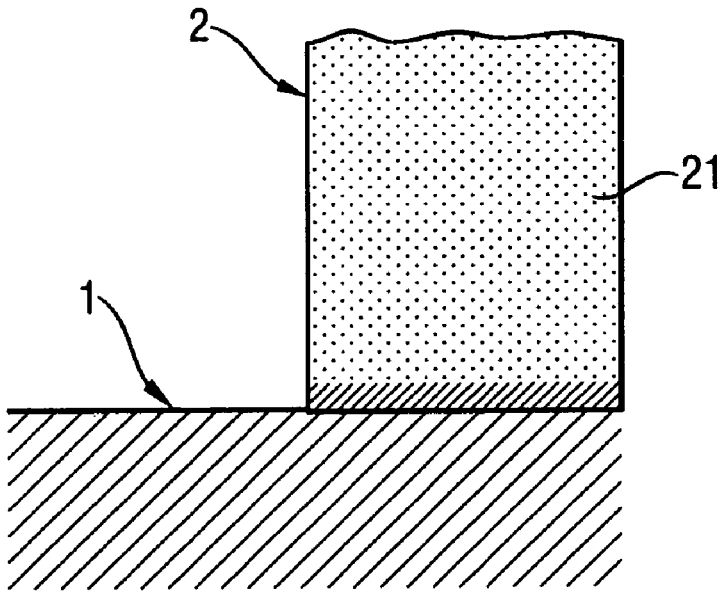
FIG. 5 shows a tooth of a grinding wheel and an excerpt from a semiconductor wafer as well as the main action area of the tooth of the grinding wheel in the case of a low rate of advance.
Figure 6:
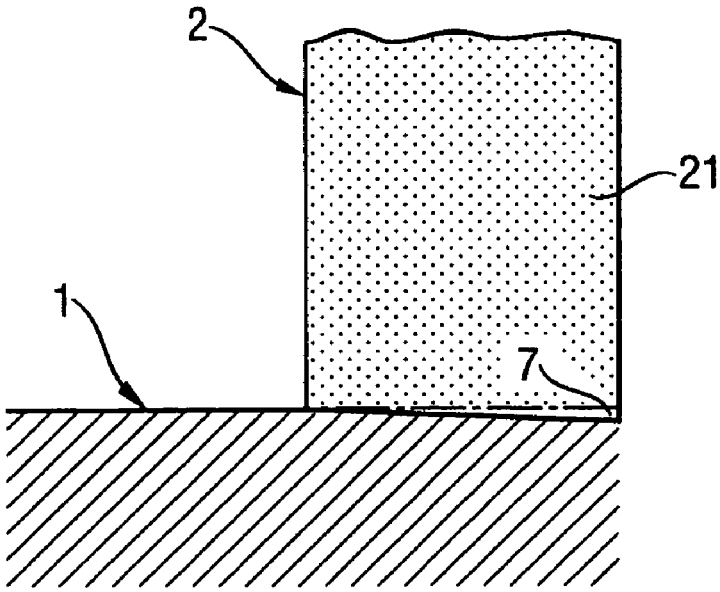
FIG. 6 shows a tooth of a grinding wheel and an excerpt from a semiconductor wafer as well as a grinding point after wear to the tooth of the grinding wheel in the case of a low rate of advance.
Figure 7:
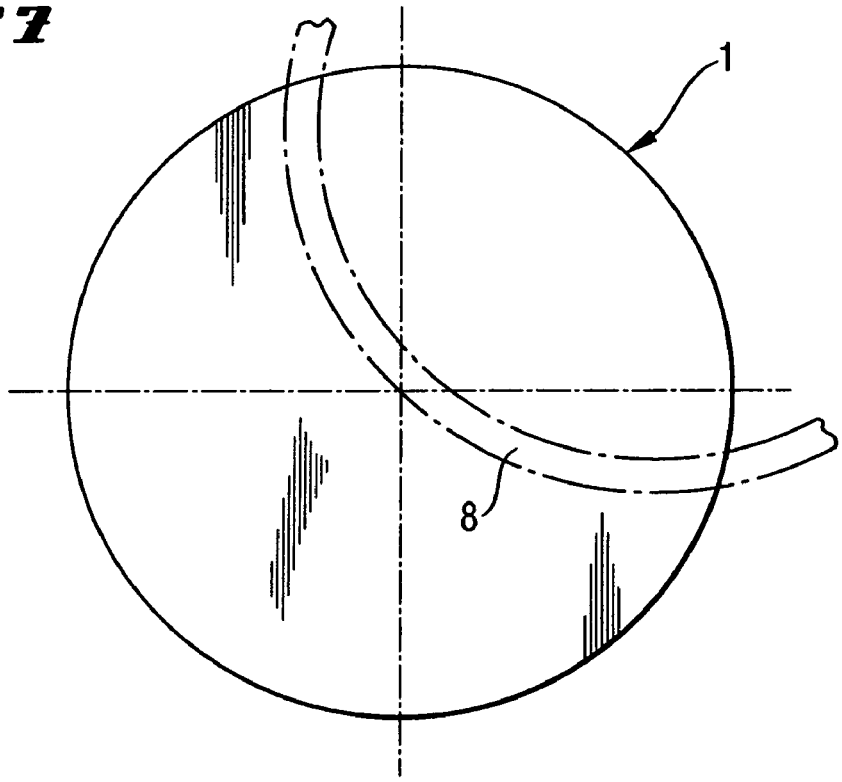
FIG. 7 shows a semiconductor wafer and the main action area of a grinding wheel in the case of a low rate of advance.
Figure 8:
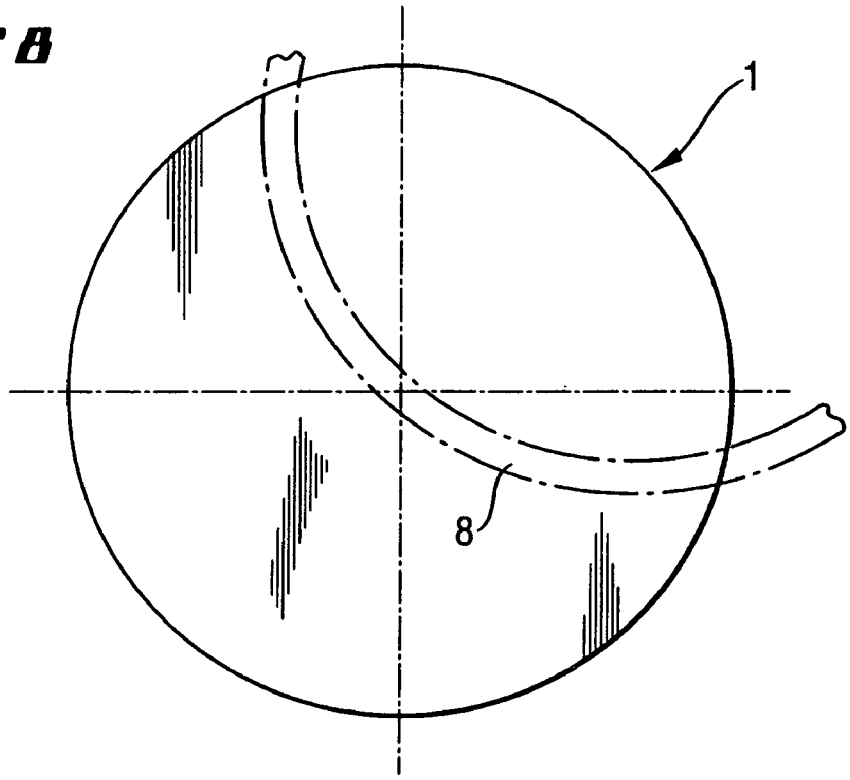
FIG. 8 shows a semiconductor wafer and the main action area of a grinding wheel in the case of a high rate of advance.
Figure 9:
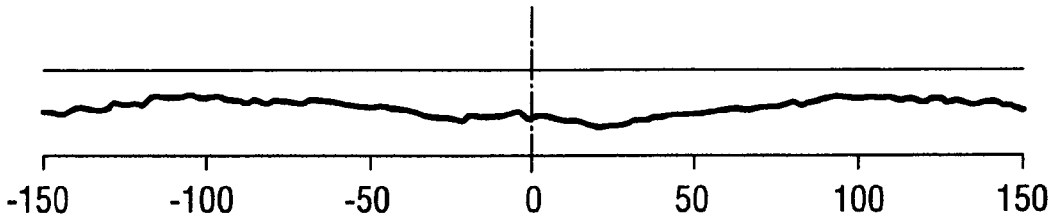
FIG. 9 shows the result of GBIR measurements carried out on a semiconductor wafer after grinding with a low rate of advance.

FIG. 9 illustrates the results of a GBIR measurement carried out on this semiconductor wafer. There is a noticeable reduction in the defect in the center of the semiconductor wafer compared to the comparative example.

COMPARATIVE EXAMPLE

In this case, the surface of a semiconductor wafer with a diameter of 300 mm was likewise ground, but in this case with an advance of x=2 μm, and was then likewise tested for roughness and GBIR.

Semiconductor wafer 2, rotational speed of the semiconductor wafer n=5 RPM, advance x=2 μm.

The following values were found for the roughness:

Front surface: 105.0 Å±6.1 Å

Back surface: 99.0 Å±2.7 Å.

Figure 10:
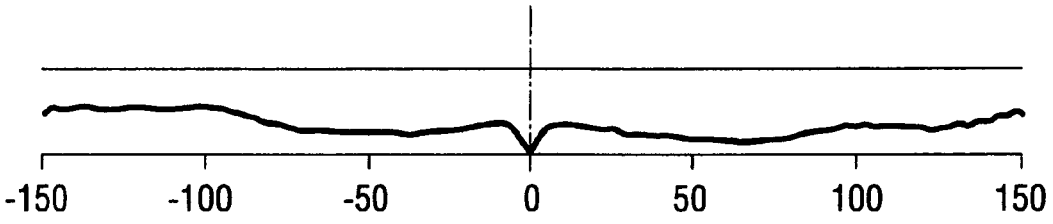
FIG. 10 shows the result of GBIR measurements on a semiconductor wafer after grinding with a high rate of advance.

FIG. 10 illustrates the results of a GBIR measurement carried out on this semiconductor wafer. A clear defect can be seen in the center of the semiconductor wafer.

Therefore, significantly better roughness values were found after grinding with a low rate of advance of grinding wheel and semiconductor wafer of x=0.033 μm. The method according to the invention leads not only to an improvement in the geometry but also to a better surface quality of the semiconductor wafer.

We claim:

1. A method for removing material from a semiconductor wafer, comprising the steps of:

providing a wafer holder rotatable about a first axis;

holding a semiconductor wafer on the wafer holder;

providing a grinding wheel opposite the wafer holder, the grinding wheel rotatable about a second axis independently of the wafer holder, wherein the first axis and the second axis are substantially parallel, and further wherein the grinding wheel is laterally offset with respect to the semiconductor wafer to provide for an axial center of the semiconductor wafer to pass into a working range of the grinding wheel; and moving at least one of the grinding wheel and the semiconductor wafer toward the other at an infeed rate, while the semiconductor wafer is rotating about the first axis at a first rotational speed and the grinding wheel is rotating about the second axis at a second rotational speed, grinding a surface of the semiconductor wafer until a desired amount of material has been removed, wherein the first rotational speed and the infeed rate are selected such that the grinding wheel and semiconductor wafer are advanced toward one another by a distance of between about 0.03 μm and about 0.5 μm during one revolution of the semiconductor wafer.

2. The method of claim 1, wherein the grinding wheel includes a fine grain size of about #2000 or finer.

3. The method of claim 1, wherein the rotational speed of the grinding wheel is between about 1000 RPM and about 5000 RPM.

4. The method of claim 1, wherein the first rotational speed is between about 50 RPM and about 300 RPM.

5. The method of claim 4, wherein the rotational speed of the semiconductor wafer is between about 200 RPM and about 300 RPM.

6. The method of claim 1 wherein the infeed rate is between about 10 μm/min and about 20 μm/min.

7. The method of claim 1, wherein the first rotational speed and the infeed rate are selected such that the grinding wheel and semiconductor wafer are advanced toward one another by a distance of between about 0.03 and about 0.1 μm during one revolution of the semiconductor wafer.

8. The method of claim 1 further including the step of:

after the grinding step, performing a spark-out step.

9. The method of claim 8 further including the step of:

after the spark-out step, moving at least one of the grinding wheel and the semiconductor wafer away from the other at a return rate.

10. The semiconductor wafer prepared in accordance with claim 1.

11. A method for removing material from a semiconductor wafer, comprising the steps of:

providing a wafer holder rotatable about a first axis;

holding a semiconductor wafer on the wafer holder;

providing a grinding wheel opposite the wafer holder, wherein the grinding wheel includes at least one tooth defining a working range, the grinding wheel rotatable about a second axis independently of the wafer holder, and further wherein the grinding wheel is laterally offset with respect to the semiconductor wafer to provide for an axial center of the semiconductor wafer to pass into the working range of the grinding wheel; and moving at least one of the grinding wheel and the semiconductor wafer toward the other at an infeed rate, while the semiconductor wafer is rotating about the first axis at a first rotational speed and the grinding wheel is rotating about the second axis at a second rotational speed, grinding a surface of the semiconductor wafer with a lower surface of the tooth of the grinding wheel, wherein the tooth wears as a result of the grinding in a main action area, wherein the first rotational speed and the infeed rate are selected such that the main action area is substantially confined to the lower surface of the tooth.

12. The method of claim 11 wherein the grinding wheel and the semiconductor wafer are advanced toward one another by a distance of between about 0.03 μm and about 0.5 μm during one revolution of the semiconductor wafer.

13. The method of claim 11, wherein the grinding wheel includes a fine grain size of about #2000 or finer.

14. The method of claim 11, wherein the rotational speed of the grinding wheel is between about 1000 RPM and about 5000 RPM.

15. The method of claim 11, wherein the first rotational speed is between about 50 RPM and about 300 RPM.

16. The method of claim 11, wherein the rotational speed of the semiconductor wafer is between about 200 RPM and about 300 RPM.

17. The method of claim 11 wherein the infeed rate is between about 10 μm/min and about 20 μm/min.

18. The method of claim 11, wherein the first rotational speed and the infeed rate are selected such that the grinding wheel and semiconductor wafer are advanced toward one another by a distance of between about 0.03 and about 0.1 μm during one revolution of the semiconductor wafer.

19. The semiconductor wafer prepared in accordance with claim 11.

20. A method for removing material from a semiconductor wafer, comprising the steps of:

providing a wafer holder rotatable about a first axis;

holding a semiconductor wafer on the wafer holder;

providing a grinding wheel opposite the wafer holder, the grinding wheel rotatable about a second axis independently of the wafer holder, wherein the first axis and the second axis are substantially parallel, and further wherein the grinding wheel is laterally offset with respect to the semiconductor wafer to provide for an axial center of the semiconductor wafer to pass into a working range of the grinding wheel; and moving at least one of the grinding wheel and the semiconductor wafer toward the other at an infeed rate, while the semiconductor wafer is rotating about the first axis at a first rotational speed and the grinding wheel is rotating about the second axis at a second rotational speed, grinding a surface of the semiconductor wafer, wherein the first rotational speed is between about 200 and about 300 RPM and further wherein the infeed rate is between about 10 μm/min and about 20 μm/min.

* * * * *